US006848497B2

(12) United States Patent
Sale et al.

(10) Patent No.: US 6,848,497 B2
(45) Date of Patent: Feb. 1, 2005

(54) CASTING APPARATUS

(75) Inventors: Alan R. Sale, Spokane, WA (US); Sylvain P. Tremblay, Chicoutimi (CA); Richard J. Collins, Spokane, WA (US)

(73) Assignee: Pyrotek, Inc., Spokane, WA (US)

( * ) Notice: Subject to any disclaimer, the term of this patent is extended or adjusted under 35 U.S.C. 154(b) by 16 days.

(21) Appl. No.: 10/414,119

(22) Filed: Apr. 15, 2003

(65) Prior Publication Data

US 2004/0206473 A1 Oct. 21, 2004

(51) Int. Cl.[7] ..... B22D 11/10
(52) U.S. Cl. ..... 164/439; 164/437
(58) Field of Search ..... 164/439, 437, 164/486, 487, 488

(56) References Cited

U.S. PATENT DOCUMENTS 4,372,544 A * 2/1983 LaBate ..... 266/281
4,597,432 A * 7/1986 Collins et al. ..... 164/444
4,986,337 A * 1/1991 Soulier ..... 164/420
5,042,861 A * 8/1991 Trundle et al. ..... 294/19.1
5,880,046 A * 3/1999 Delvaux et al. ..... 501/123
5,976,718 A * 11/1999 Melcher ..... 428/702

* cited by examiner

*Primary Examiner*—Kiley S. Stoner
*Assistant Examiner*—I.-H. Lin

(57) ABSTRACT

A metal distribution system for the simultaneous production of a plurality of logs or round billets from molten metal comprising: 1) a trough for the introduction of molten metal; 2) a plurality of side streams extending from the trough and each of the side streams including a plurality of opposing apertures each of the apertures including a thimble for the shaping of molten metal passing through the trough and the side streams and into the thimbles. A uniform flow of molten metal into the side streams and the individual apertures is provided by the controlled negative angular orientation of the most upstream opposing pair of apertures thereby providing relative uniformity of the temperature of molten metal reaching each of the plurality of apertures. A unique unitized thimble configuration and trough damming arrangement are also described.

19 Claims, 5 Drawing Sheets

CASTING APPARATUS

FIELD OF THE INVENTION

The present invention relates to apparatus useful in the casting of molten metal and more particularly to such devices as are utilized in the casting of so-called "logs", "billet" or "round ingots" from, for example, molten aluminum.

BACKGROUND OF THE INVENTION

In the casting of molten metals such as aluminum apparatus and processes have been developed for the simultaneous casting of a plurality of logs, billets or round ingots, hereinafter logs, so as to increase the efficiency and productivity of the casting processes. In such processes and apparatus, a casting table having a plurality of apertures or molds is mounted over a pit from which emerge an equally numbered plurality of hydraulically operated bottom blocks. Each of the bottom blocks is registered, i.e. aligned with, one of the molds. The casting table includes troughs or distribution channels for the dissemination of molten metal introduced thereto to each of the individual molds or apertures located in the casting table. As metal from the distribution channels or troughs in the casting table enters the individual molds, the plurality of bottom blocks is lowered in unison to allow for removal of metal that has solidified in the mold therefrom and to provide space for the introduction of additional incoming molten metal. Such a prior art casting table is shown in FIG. 1 and described in greater detail hereinafter.

While the metal distribution of the casting tables of the prior art as depicted in FIG. 1 have proven highly useful and reliable over many years of service in a multitude of installations, they suffer a number of shortcomings.

As those skilled in the molten metal casting arts are well aware, it is critically important that molten metal reaching each of the molds or apertures at substantially the same time with minimal temperature loss to obtain a successful cast of the plurality logs being simultaneously cast. If metal reaching one or more apertures is too hot or hold time is too short and does not solidify as the base plate descends, a "bleedout" can result. In such a condition, molten metal can be brought into contact with water applied as a spray in the process to cool the solidifying metal. Such a conditions requires rapid plugging of the aperture or mold that is experiencing the "bleedout" with the result that that portion of the production is lost for the cast. Alternatively, if metal has resided in the mold for too long a period, it may be cooler than the balance of the molten metal and therefore solidify more quickly in the mold than metal entering other molds in the casting table resulting in a "freeze-in", i.e. the solidified metal becomes caught in the mold. Freeze in can drop out during casting and also result in bleedout. Such a condition can result the aborting of the cast entirely and necessitating a freeing up of the metal caught in the mold and a restart of the cast. Such errors can cause significant productivity losses and place operators in significant danger from a safety standpoint. If metal enters the mold with too much velocity or too hot, penetrates between the mold and the head, solidified ingot head "flashing" may occur. Flashing is another condition that may result in molten metal coming into contact with cooling water applied to the ingot below the solidification point. Flashing also causes damage to molds or distortion or delays in the bottom block movement that can also result in casting defects, bleedouts or complete table freeze in.

In addition to the foregoing, as will be explained in greater detail below, the design of the prior art "dams", i.e. barriers that control the flow of molten metal into the distribution troughs within the casting table, often required the presence of at least two operators on the casting table at the initiation of a casting drop to "lift" or remove the dams at the start of the cast. The presence of operators in the immediate vicinity of the molten metal casting operation is always a safety concern, and the ability to eliminate the exposure of operators to such a risk is critically important to casting facilities.

Finally, the mold portions of the prior art casting tables comprise multi-part elements that require assembly in the casting table costing valuable assembly or set-up time and which because of their design leave exposed joints between the individual elements of the assembly that are sometimes prone to leaking, particularly if not properly assembled.

OBJECTS OF THE INVENTION

It is therefore an object of the present invention to provide a multi-strand metal distribution system that provides more uniform molten metal distribution at the start of a cast, minimizes heat loss and controls the velocity and fill time differences of molten metal entering the molds.

It is another object of the present invention to provide a thimble assembly for the above-described multi-strand metal distribution systems that because of their design and construction provide simplified and more secure installation of the mold assemblies.

It is yet another object of the present invention to provide a metal distribution system that incorporates an improved dam release mechanism that obviates the need for the presence of operators on the casting table to release dams during start up of a cast.

SUMMARY OF THE INVENTION

According to the present invention, there is provided a metal distribution system for the simultaneous production of a plurality of logs or round billets from molten metal comprising: 1) a single main trough for the introduction of molten metal; 2) a plurality of side streams extending from the trough and each of the side streams including a plurality of opposing pairs of apertures each of the apertures including a mold for the shaping of molten metal passing through the trough and the side streams and into the molds. A controlled velocity and uniform flow of molten metal into the side streams and the individual apertures is provided by the controlled negative angular orientation of the entry angle of the most upstream of the opposing aperture pairs thereby providing relative uniformity of the temperature of molten metal reaching each of the plurality of apertures. A unique unitized thimble configuration and trough damming arrangement are also described.

DETAILED DESCRIPTION

Figure 1:
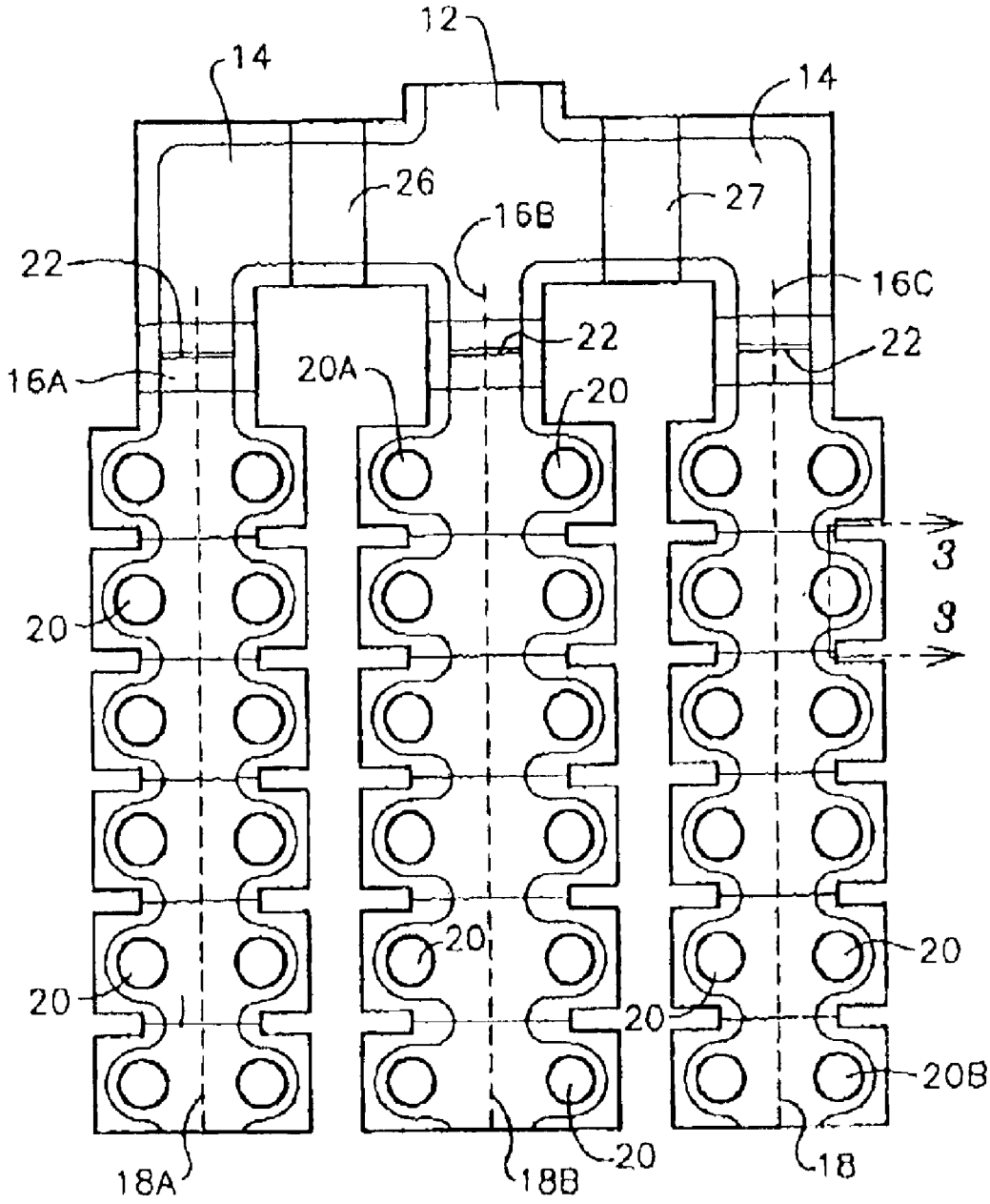
FIG. 1 PRIOR ART
FIG. 1 is a top view of a metal distribution system of the prior art.

Referring now to FIG. 1, in the prior art a metal distribution system 10 for the simultaneous production of multiple logs or round billets comprised an inlet 12 feeding a primary trough 14 that in turn fed secondary troughs 16*a*, 16*b* and 16*c*. Located at approximately right angles to the major (long) axes 18*a*, 18*b* and 18*c* of secondary troughs 16*a*, 16*b* and 16*c* and on opposing sides thereof are pairs of opposed round apertures 20 (only some being specifically identified in FIG. 1 for clarity) each of apertures 20 containing a mold as will be described below in connection with FIG. 3. Insertion of manual dams 22 requires manual removal to begin the flow of metal into troughs 16*a*, 16*b* and 16*c*. In the casting operation, molten metal was provide to primary trough 14, passed therethrough to secondary troughs 16*a*, 16*b* and 16*c* and thence into apertures 20. While, as previously mentioned such a structure has provided a highly useful arrangement, it did demonstrate several shortcomings. Among these were that all of apertures 20 did not fill at the same time, thus resulting in temperature and solidification differences inside the sump between the first and last to fill in molten metal entering, for example the aperture designated 20*a* and that designated 20*b* in FIG. 1. Such a condition can and often did lead to the problems previously referred to as "bleedout" or "freeze-in". Additionally, the casting practice commonly used with a metal distribution system of this type called for starting the flow of molten metal through inlet 12 and then sequentially and manually removing dams 22. The need to manually operate the damming arrangement required the presence of operators, most generally 2 on the surface of casting table 10 to perform removal of the dams. This posed a significant safety hazard as the presence of personnel in the immediate area of the casting table is always a cause for safety concern. Thus, the design and availability of a casting table that eliminated such issues have been a long sought after objectives.

Figure 2:
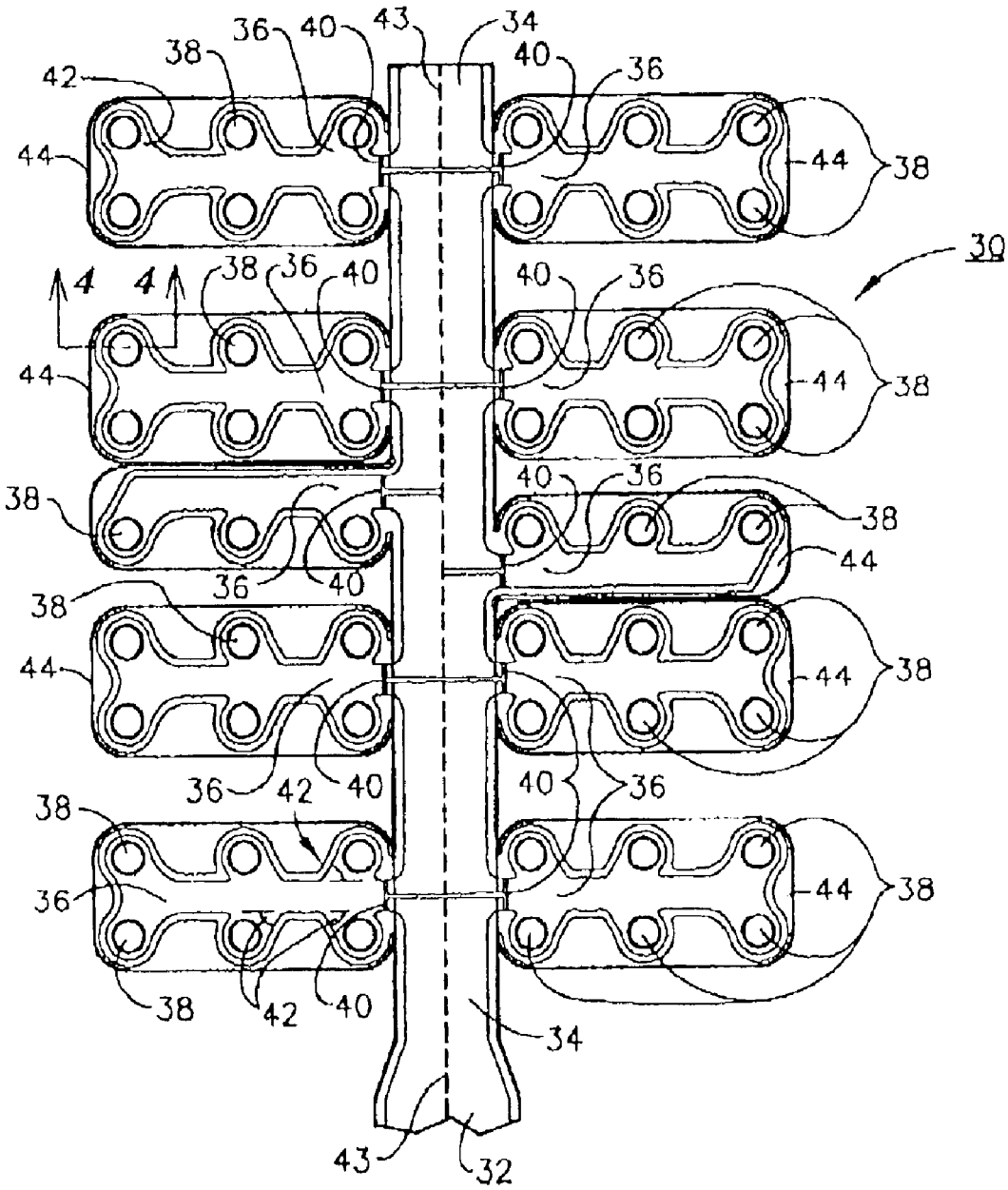
FIG. 2 is a top view of one embodiment of the metal distribution system of the present invention.

Referring now to FIG. 2 that presents a top plan view of the metal distribution system 30 of the present invention, there is provided an inlet 32 feeding a single preferably centrally located primary trough 34 having a plurality of relatively short secondary troughs 36 each feeding a plurality of opposing apertures 38 (not all numbered in FIG. 2 for clarity) that contain molds (not shown in FIG. 2). Dams 40 are provided at the entry of each of secondary troughs 36. Dams 40 are controlled by a pneumatically or hydraulically operated dam control arm 42 that is remotely operated from an operators station (not shown). In operation, molten metal is flowed through inlet 32 into primary trough 34 where its flow is limited by the presence of dams 40. Once primary trough 34 is filled to the appropriate level, dam control arm 43 is activated raising dams 40 allowing metal to flow simultaneously into all or selected secondary troughs 36 and thence into apertures/molds 38. Thus, primary trough 34 and secondary troughs 36 are flowably connected. Because of the angular structure of entry angles 42 as described in greater detail below, molten metal of all relatively the same fill time and temperature rapidly fills apertures/molds 38 simultaneously thereby eliminating the problems of unequal temperature metal in the casting table at different locations, i.e. providing minimum fill time and accompanying minimum temperature loss with maximum velocity to avoid flashing. The incorporation of the remotely operated dams 40, the need for the presence of operators on the casting table during the start up procedure is also eliminated.

Figure 4:
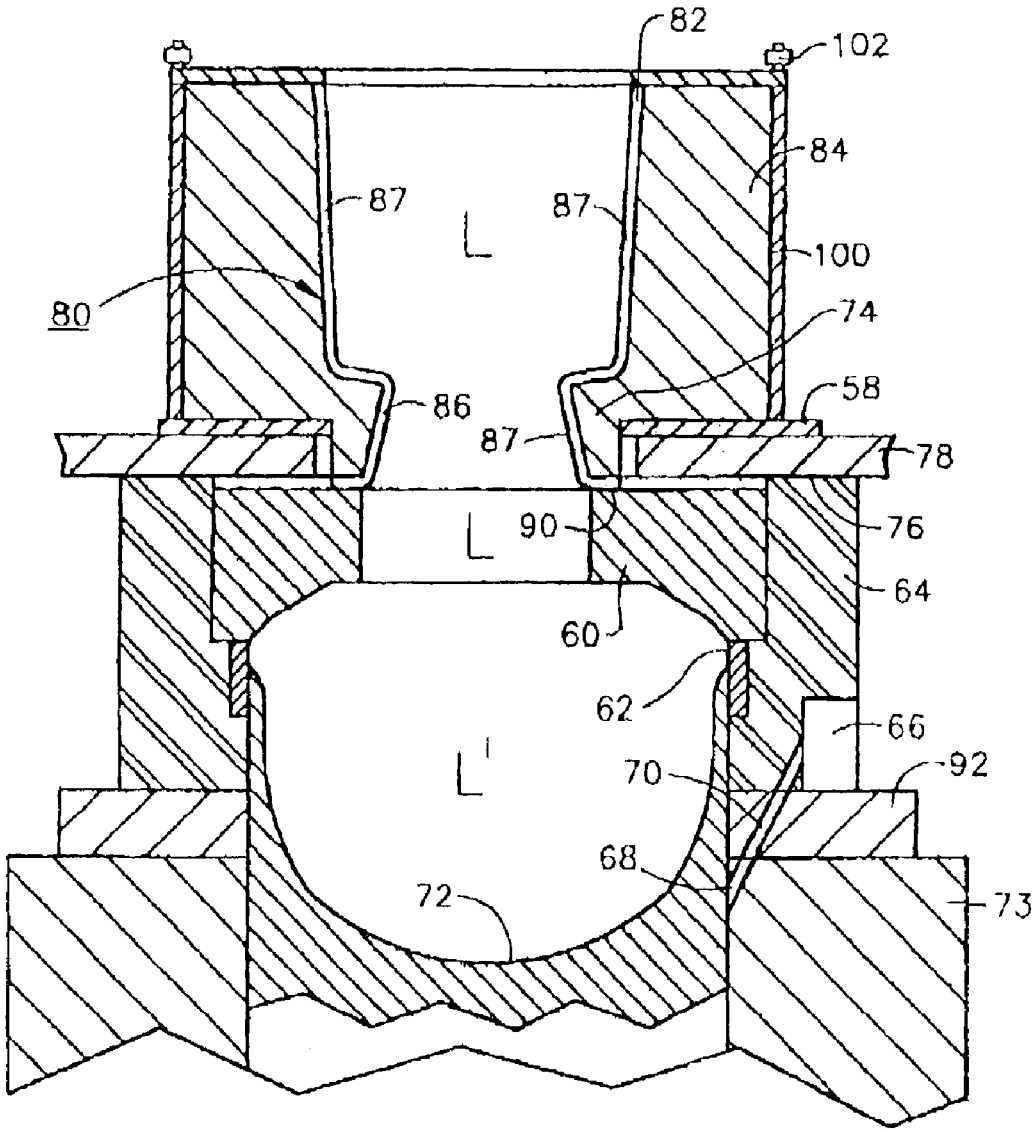
FIG. 4 is a cross-sectional view of one embodiment of a mold of the present invention.
Figure 5:
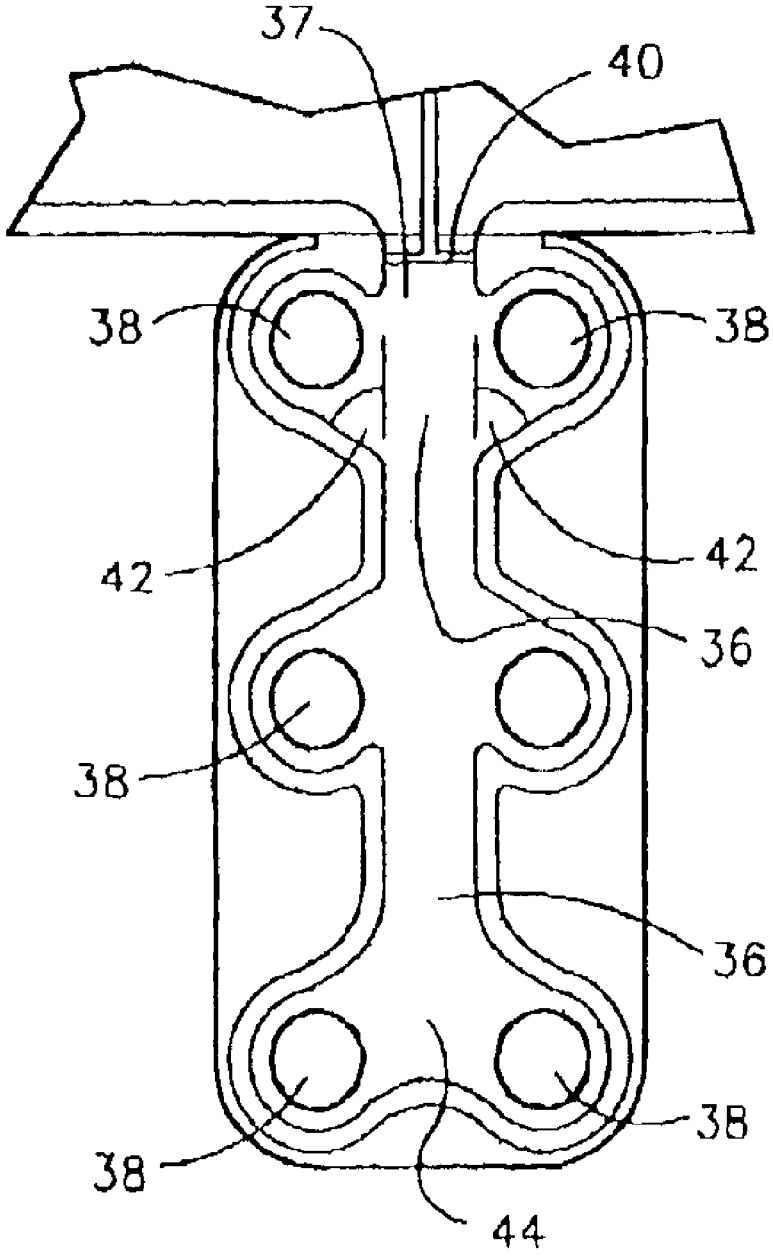
FIG. 5 is a top plan view of a single secondary trough in accordance with the present invention.

Referring now to FIGS. 4 and 5, according to a specifically preferred embodiment of the present invention, aperture entry angles 42 located at the entry of apertures 38 those proximate primary trough 34, i.e. those at the upstream end 37 of secondary troughs 36, are negative and preferably range from about 15 to about 30 degrees and most preferably between about 20 and 25 degrees. The negative orientation of these angles and their particular pitch as specified herein provide for the rapid and uniform fill of apertures 38 downstream thereof toward extremities 44 with a minimum of metal fill time and velocity into apertures 38 thus preventing metal flash and inclusion causing turbulence and providing relative temperature uniformity in the molten metal. Stated differently, filling of secondary troughs 36, because of the angular orientation of entry angles 42 results in secondary troughs 36 filling from the downstream ends 44 toward the upstream ends 37. In operation, as molten metal enters secondary troughs 36 upon the raising of dams 40 molten metal immediately flows to the outermost extremities or downstream ends 44 of secondary troughs 36 whereupon it quickly fills apertures 38 further downstream of primary trough 34 and then commences to fill secondary troughs 36 "backwards" in the direction of primary trough 34 or the upstream ends of secondary troughs 36. This action provides for the quick and controlled fill of all apertures 38 with a minimum of turbulence and with molten metal of relatively the same temperature to assure a uniform start to the cast with a minimum of the occurrence of "bleedthrough" or "freeze-in" and significant reductions in head and butt defects that reduce the need for head and butt crop and increase the productivity of the casting operation. Thus, relatively simultaneous fill time of all apertures 38 is achieved by the provision of negative entry angles 42 that are directed away from opposing apertures 38 closest to primary trough 34 thus insuring that the positions 38 furthest away from primary trough 34, i.e, closest to extremities 44 or downstream, receive metal at approximately the same time as those closest to primary trough 34 or upstream.

Figure 3:
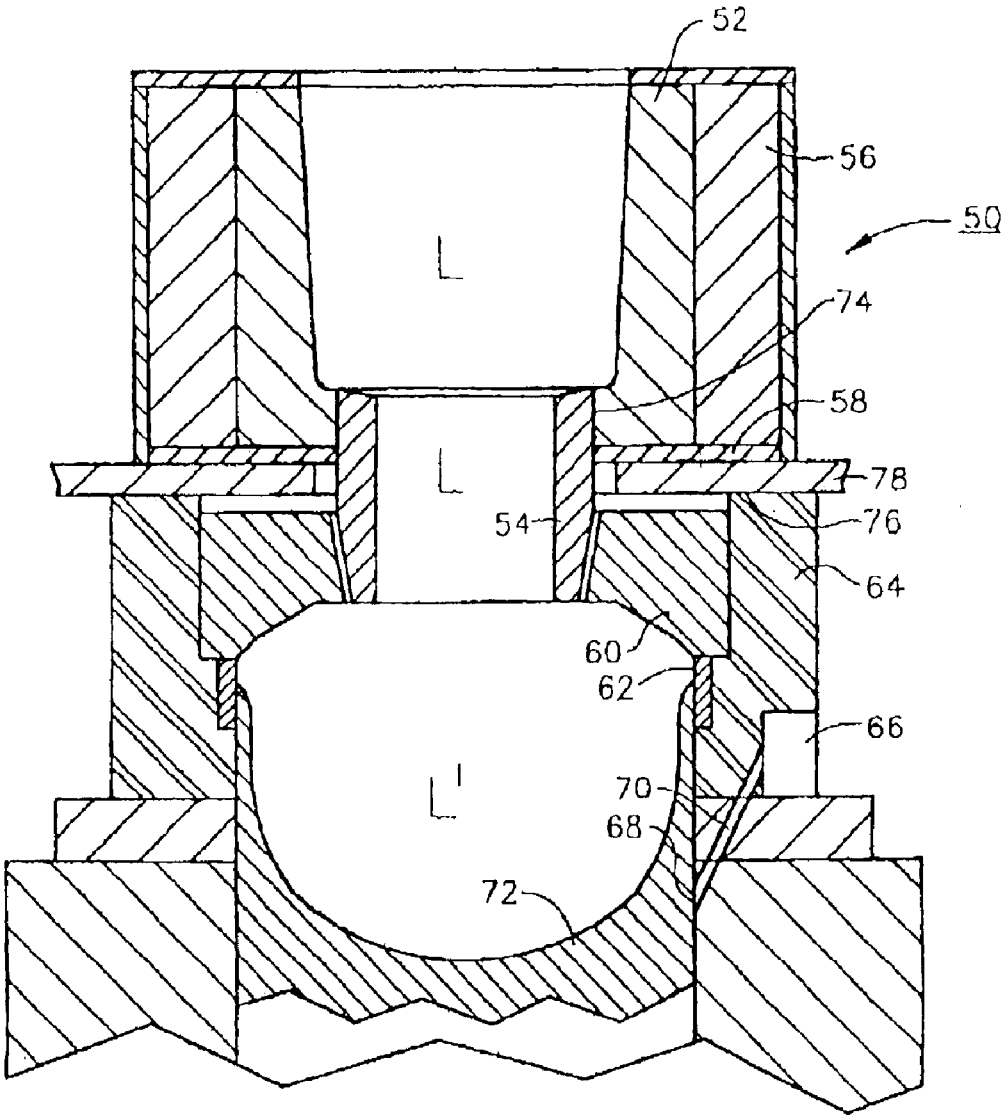
FIG. 3 PRIOR ART
FIG. 3 is a cross-sectional view of a mold of the prior art.

Each of apertures 20 and 38 contains a "mold". As shown in FIG. 3, (a cross-sectional view along the line 3—3 of FIG. 1) in the prior art, mold 50 comprised a crossfeeder 52, a thimble 54, a blanket of back-up insulation 56, a "paper" (mica or the like) or similar gasket 58, a transition plate 60, a mold body 64 and a graphite ring 62. A water reservoir 66 that produced a water spray 68 through the emission of water through spray channel 70 provided cooling of the solidifying metal 72. The letters L and L' in FIG. 3 indicates those areas where molten metal remains liquid as it moves through mold 50 before solidifying at 72. The volume L' is commonly referred to as the "sump".

In the prior art, thimble 54, crossfeeder 52, back-up insulation 56 and transition plate 60 all represented individual components that were assembled "in situ" so to speak at the casting station or in a fabrication shop before the start-up of a cast. This clearly involved a significant amount of labor. Additionally, it was not uncommon for the vertical joint 74 between thimble 54 and crossfeeder 52 to leak resulting in a bleedthrough of molten metal into joint 76 at gasket 58 between crossfeeder 52 and blanket insulation 56 and casting table structure 78. Such leakage was not only affected productivity, but could cause a safety issue under certain particularly severe leakage conditions. Additionally, the variability in assembly technique from operator to operator introduced a further element of uncertainty or variability into a casting operation that was already fraught with variables. Thus, a solution has been sought that would significantly reduce the labor intensity of the mold insertion/fabrication operation, reduce any variability in the assembly operation and reduce the potential for leakage at the previously described assembly joint(s).

Such a solution is shown in FIG. 4 that is a cross-sectional representation along the line 4—4 of FIG. 2. The improved metal handling system 80 of the present invention shown in FIG. 4 also comprises a crossfeeder 82, back-up insulation 84, and a thimble 86, but all fabricated as a monolith that simply drops into aperture 38 through horizontal engagement with mold table 88 at horizontal joint 90 and transition plate 78 that is part of mold 60 that further engages mold table bottom plate 62 supported on mold member 73. The entire structure is retained in close and tight engagement through the action of a bolt down arrangement through steel upright 100 that includes a nut 102 or other suitable fastening arrangement to bring the entire structure together. A graphite lubricating ring 62 as used in the prior art is incorporated in much the same fashion and for the same purposes as in the prior art. Cooling water sprays and a water reservoir are also preferably incorporated into the mold assembly, as shown in FIG. 4. The foregoing structure, has been found to: 1) reduce heat loss through the back-up insulation to a greater degree than the blanket back-up insulation used in the prior art; 2) results in fewer cracked logs at start up; 3) results in fewer cold start related defects such as bleedouts and freeze ins; and 4) quite obviously increases the ease of assembly, and greatly reduces the labor involved in the mold assembly operation.

What clearly differentiates refractory module 80 of the present invention is that it comprises a module that combines in a single integral unit, a hot face refractory for crossfeeder 82 and thimble 86, with a peripheral, low density, cold face refractory, back-up insulation 84 thereby eliminating the need to separately insulate behind crossfeeder 82 and thimble 86 or to assemble the individual elements at the casting station or at some remote location. It also eliminates the need for a separate vertical joint (74 in FIG. 3) since thimble 86 is cast into the refractory module 80 providing the formation of a horizontal seal 90 (rather than a vertical seal) directly with the transition plate 78.

The aim of the crossfeeder is mainly to distribute molten aluminum to the mold while minimizing turbulence and heat losses. The refractory material should be inert vis-à-vis molten aluminum, easy to clean and show a low heat storage. Prior art cross-feeders are made of light density refractories that have to be well preheated to avoid cold start-up. Depending on the material and design, maintenance can be quite extensive. The main mode of failure in such devices is crack propagation with time that renders the crossfeeder unusable. Typical life is difficult to determine because it depends on many variables such as: casting technology, design, casting parameters, maintenance, etc.

According to the present invention, two different refractory materials are used to extend the useful life of the crossfeeder and to enhance the aluminum casting process itself.

The material directly in contact with the aluminum 87 is a dense and hard refractory material showing excellent non-wetting characteristics to molten aluminum. It is provided in the form a thin skin, preferably between 6 and 10 mm thick. This material is a fiberglass fabric reinforced wollastonite that exhibits outstanding mechanical and non-wetting properties and is suitable for the fabrication of complex shapes. According to a highly preferred embodiment of the present invention the non-wetting properties of this material are further improved by coating its surface with a thin layer of boron nitride (not shown). Thin skin 87 is then backed up with a layer 84 of a highly insulating refractory material, preferably, Wollite, a mineral foam based wollastonite material. The skin 87 is used as the mold external surface and the Wollite insulation 84 is cast around this externally. The two materials constituting thin skin 87 and insulating refractory 84, have very similar thermal expansion coefficients, which avoids delamination and cracking during the heat up and casting cycles. This material combination exhibits a number of desirable characteristics/advantages. Among these are: mechanical strength; crack propagation minimization because of structure; repairability; reduced heat transfer and therefore more consistent molten metal temperature; significantly reduced crossfeeder weight and casting table weight significantly reduced heat storage and table preheating schedule; and reduced steel shell temperature due to increased insulation factors thereby minimizing steel expansion, joint maintenance and crack propagation.

Thus, in the casting insert 80 of the present invention, cylindrical crossfeeder 82 and cylindrical thimble 86 present a continuous, joint free and uninterrupted cylindrical interior surface 87 surrounded by an integral peripheral layer of back-up insulation 84.

While the elements of the monolithic assembly of the present invention can be fabricated from a wide variety of compatible materials, according to a highly preferred embodiment of the invention, crossfeeder 82 is formed from an SH or RFM Insural material available from Pyrotek, Inc. East 9503 Montgomery Ave, Spokane, Wash. RFM Insural is a moldable light density refractory composite material comprised of fiberglass fabric reinforced wollastonite. Back-up insulation 84 comprises Wollite an insulating castable also available from Pyrotek, Inc. Wollite is a solid light-weight mineral foam that is stable during its preparation and during curing and drying. It is a phosphate bonded foam insulation that can be made in densities ranging from 320 to 880 $kg/m^3$ and is mainly composed of wollastonite, a calcium silicate. Crossfeeder 82, thimble 86 and backup insulation 84 can also be cast as a single unit. This is made possible by the compatibility of the various materials of fabrication.

There have thus been described: a novel metal distribution system incorporating; an automated and remotely operable dam removal system; and a monolithic mold insert assembly that each individually demonstrate significant operating advantages and which when combined into a single operating system provide a significantly improved log or round ingot casting system that is economically desirable and simultaneously provides noteworthy safety improvements.

As the invention has been described, it will be apparent to those skilled in the art that the same may be varied in any ways without departing from the spirit and scope thereof. Any and all such modifications are intended to be included within the scope of the appended claims.

What is claimed is:

1. An integral molten metal casting insert comprising:

A) a cylindrical cross feeder having an interior surface of a first diameter;

B) a cylindrical thimble having an interior surface of a second diameter; and

C) integral backup insulation all formed as a single monolithic structure with said cross feeder interior surface and said thimble interior surface comprising a continuous, joint free and uninterrupted cylindrical insert surface peripherally surrounded by said integral back-up insulation.

2. The integral molten metal casting insert of claim 1 wherein said cylindrical crossfeeder and said thimble are fabricated from a refractory material and said back-up insulation comprises a castable insulating material.

3. The integral molten metal casting insert of claim 2 wherein said refractory material is a low density refractory material.

4. The integral molten metal casting insert of claim 3 wherein said low density refractory comprises a fiber glass fabric impregnated with a wollastonite slurry.

5. The integral molten metal casting insert of claim 2 wherein said castable insulating material comprises phosphate bonded mineral foam composed primarily of calcium silicate.

6. Metal distribution system for casting molten metal comprising:

A) a primary trough

B) plurality of secondary troughs flowably connected to said primary trough, each of said secondary troughs having an upstream end abutting said primary trough and a downstream end remote from said primary trough;

C) a plurality of opposing pairs of apertures arranged along said secondary troughs into which metal entering said secondary troughs pours for the casting of molten metal into solid metal, that opposing pair of said apertures closest to said primary trough being designated as the first opposing pair; and D) entry angles at each of said apertures of said first opposing pair;

said entry angles being negative angles such that metal entering said secondary troughs flows first to apertures located downstream of said first opposing pair and only initiates filling of said first opposing pair once filling of apertures downstream thereof have commenced filling.

7. The metal distribution system of claim 6 further including dams at the entry to each of said secondary troughs.

8. The metal distribution system of claim 7 further including a dam control arm that permits remote operation of said dams.

9. The metal distribution system of claim 8 wherein said dam control arm is pneumatically or hydraulically operated.

10. The metal distribution system of claim 6 wherein said entry angle ranges from about 15 to about 30 degrees.

11. The metal distribution system of claim 10 wherein said entry angle ranges from about 20 to about 25 degrees.

12. A metal distribution system for casting molten metal comprising:

A) a primary trough;

B) a plurality of secondary troughs flowably connected to said primary trough, each of said secondary troughs having an upstream end abutting said primary trough and a downstream end remote from said primary trough;

C) a plurality of opposing pairs of apertures arranged along said secondary troughs into which metal entering said secondary troughs pours through for casting of molten metal into solid metal;

D) entry angles at each point where each of said apertures joins said secondary troughs; and E) in each of said apertures, an integral molten metal casting insert comprising:

I) a cylindrical crossfeeder having an interior surface of a first diameter;

II) a cylindrical thimble having an interior surface of a second diameter; and

III) integral back-up insulation;

all formed as a single monolithic structure with said crossfeeder interior surface and said thimble interior surface comprising a continuous, joint free and uninterrupted cylindrical insert surface peripherally surrounded by said integral back-up insulation; said entry angles being negative angles such that metal entering said secondary troughs flows first into apertures located at said downstream ends of said secondary troughs thereby causing said secondary troughs to till with molten metal from the downstream ends to the upstream ends.

13. The metal distribution system of claim 12 further including dams at the entry to each of said secondary troughs.

14. The metal distribution system of claim 13 further including a dam control arm that permits remote operation of said dams.

15. The metal distribution system of claim 14 wherein said dam control arm is pneumatically or hydraulically operated.

16. The metal distribution system of claim 12 wherein said cylindrical crossfeeder and said thimble are fabricated from a refractory material and said back-up insulation comprises a castable refractory.

17. The metal distribution system of claim 16 wherein said refractory material is a low density refractory composite material.

18. The metal distribution system of claim 17 wherein said low density refractory comprises fiber glass fabric impregnated with a wollastonite slurry.

19. The metal distribution system of claim 16 wherein said castable insulating material comprises a phosphate bonded mineral foam composed primarily of calcium silicate.

* * * * *